US007540686B2

(12) United States Patent
Heims

(10) Patent No.: US 7,540,686 B2
(45) Date of Patent: Jun. 2, 2009

(54) VIBRATORY PAVING SCREED FOR A PAVER

(75) Inventor: Dirk Heims, Bad Münder (DE)

(73) Assignee: ABG Allgemeine Baumaschinen-Gesellschaft mbH, Hameln (DE)

( * ) Notice: Subject to any disclaimer, the term of this patent is extended or adjusted under 35 U.S.C. 154(b) by 81 days.

(21) Appl. No.: 11/203,391

(22) Filed: Aug. 11, 2005

(65) Prior Publication Data

US 2006/0034658 A1 Feb. 16, 2006

(30) Foreign Application Priority Data

Aug. 11, 2004 (DE) ..... 10 2004 038 900

(51) Int. Cl.
*E01C 19/38* (2006.01)

(52) U.S. Cl. ..... 404/102; 404/114; 404/118

(58) Field of Classification Search ..... 404/114, 404/101, 102, 113, 118
See application file for complete search history.

(56) References Cited

U.S. PATENT DOCUMENTS

| | | | | | |
|---|---|---|---|---|---|
| 2,757,588 | A | * | 8/1956 | Pollitz | 404/114 |
| 2,771,012 | A | * | 11/1956 | Jackson | 404/113 |
| 3,838,933 | A | * | 10/1974 | Lehman et al. | 404/114 |
| 4,502,813 | A | * | 3/1985 | Hojberg | 404/102 |
| 4,507,014 | A | * | 3/1985 | Heims et al. | 404/102 |
| 4,714,374 | A | * | 12/1987 | Mihara | 404/91 |
| 4,722,636 | A | * | 2/1988 | Brock | 404/84.1 |
| 5,096,331 | A | * | 3/1992 | Raymond | 404/118 |
| 5,261,762 | A | * | 11/1993 | Yamaguchi | 404/133.05 |
| 5,417,516 | A | * | 5/1995 | Birtchet | 404/71 |
| 5,516,231 | A | * | 5/1996 | Heims et al. | 404/102 |
| 5,533,828 | A | * | 7/1996 | Campbell | 404/75 |
| 5,735,634 | A | * | 4/1998 | Ulrich et al. | 404/102 |
| 5,868,522 | A | * | 2/1999 | Campbell | 404/114 |
| 5,947,638 | A | * | 9/1999 | Heims | 402/102 |
| 6,124,580 | A | * | 9/2000 | Nottmeier et al. | 219/635 |
| RE36,981 | E | * | 12/2000 | Birtchet | 404/71 |
| 6,238,135 | B1 | * | 5/2001 | Rower | 404/84.5 |
| 6,334,735 | B1 | * | 1/2002 | Williams et al. | 404/79 |
| 6,352,386 | B2 | * | 3/2002 | Heims | 404/84.5 |
| 6,551,018 | B2 | * | 4/2003 | Baker et al. | 404/102 |
| 2002/0168226 | A1 | * | 11/2002 | Feucht et al. | 404/84.1 |

FOREIGN PATENT DOCUMENTS

EP 641 887 B1 * 7/1997

* cited by examiner

*Primary Examiner*—Gary S Hartmann
(74) *Attorney, Agent, or Firm*—Alix, Yale & Ristas, LLP

(57) ABSTRACT

The invention relates to a vibratory paving screed for a paver, comprising a baseplate and a vibration drive therefor and also comprising a front wall which is mounted upstream of the baseplate in the paving direction, is fixed with respect to the baseplate and engages with the baseplate, in which arrangement the baseplate comprises a section of uniform thickness and, in the region of its front edge, a separate, solid strip which is connected to the section and has a metering slope and a flat run-in bevel situated behind.

14 Claims, 3 Drawing Sheets

VIBRATORY PAVING SCREED FOR A PAVER

FIELD OF THE INVENTION

The invention relates to a vibratory paving screed for a paver as it is used for instance for the construction of roads.

BACKGROUND OF THE INVENTION

Pavers with a chassis and with a trailed, floating paving screed articulated on this chassis via tow arms, the angle of attack of the paving screed being adjustable with respect to the ground and the paving screed having a pre-strike-off and a baseplate coupled to a vibration drive, are known both without as well as with at least one tamper bar which can move up and down by means of a drive and which has a variable number of strokes (with regard to the latter, cf., for example, German Patent No. DE 198 36 269 C1).

The action of a tamper device in tamping/vibratory paving screeds consists in a metering action which results in a high degree of compaction and in uniform compaction with respect to the mix to be placed. In the metering paving process, excess mix escapes to the front via a slope in the front region of the tamper bar, depending on a defined resistance of the mix to deformation. Without a tamper device, the result is a much more non-uniform compaction in the layer laid by the paver. This leads, inter alia, to correspondingly large unevenesses following the subsequent rolling operation performed by a compaction roller.

Furthermore, it is known to at least partially compensate for the absence of metering action of a vibratory paving screed by means of height-adjustable pre-strike-offs which interact with a front edge of the baseplate of the vibratory paving screed, this front edge being folded upwards at 60° to 90°, in order to avoid a situation, particularly when placing thin layers, for instance asphalt wearing courses, where too much mix gets under the vibratory paving screed and a thicker layer than desired is thus placed. The absence of metering function is essentially attributable to the radius which results during folding of the front edge of the baseplate. Moreover, height-adjustable pre-strike-offs are very elaborate and expensive and also difficult to handle.

Owing to the absence of precompaction afforded by a tamper, the angle of attack of a vibratory paving screed is considerably greater, i.e. the rear edge, as seen in the paving direction, of the paving screed is situated considerably lower than its front edge. As a result, the baseplates of the paving screed wear very unevenly and thus prematurely. In addition, in the case of vibratory paving screeds which have, arranged behind a main screed, widening parts in the form of hydraulically extendable extension screeds or added-on screed parts, the large angle of attack of the screed means that the widening parts have to have their height adjusted very frequently in order to align the rear edges of the baseplates of the main screed and its widening parts with one another.

SUMMARY OF THE INVENTION

An object of the invention is to provide a vibratory paving screed for a paver in which, in spite of the absence of a tamper device, it is possible to dispense with a height-adjustable pre-strike-off.

It is a further object of the invention to provide a vibratory paving screed for a paver with a substantially reduced wear of the baseplate.

It is still another object of the invention to provide a vibratory paving screed for a paver with which a satisfactorily compaction may be achieved without a height-adjustable pre-strike-off.

Owing to the fact that use is accordingly made of a baseplate which comprises a separate, solid strip with a metering slope in the region of its front edge, it is possible, in the case of a vibratory paving screed without a tamper device and without the height adjustability of the pre-strike-off, to substantially reduce the wear of the baseplate, to achieve a satisfactorily uniform compaction and, particularly even in the case of thin layers, to maintain the layer thickness during paving. In this connection, the metering slope additionally results in increased compaction of the mix and in more uniform compaction, even when there are unevenesses in the subgrade. Moreover, handling is significantly improved here and the wear of the baseplates is also reduced.

Further objects, advantages and embodiments of the invention can be taken from the description below.

BRIEF DESCRIPTION OF THE DRAWINGS

The invention is explained in more detail below by way of exemplary embodiments which are schematically represented in the appended drawings.

DETAILED DESCRIPTION OF THE PREFERRED EMBODIMENTS

Figure 1:
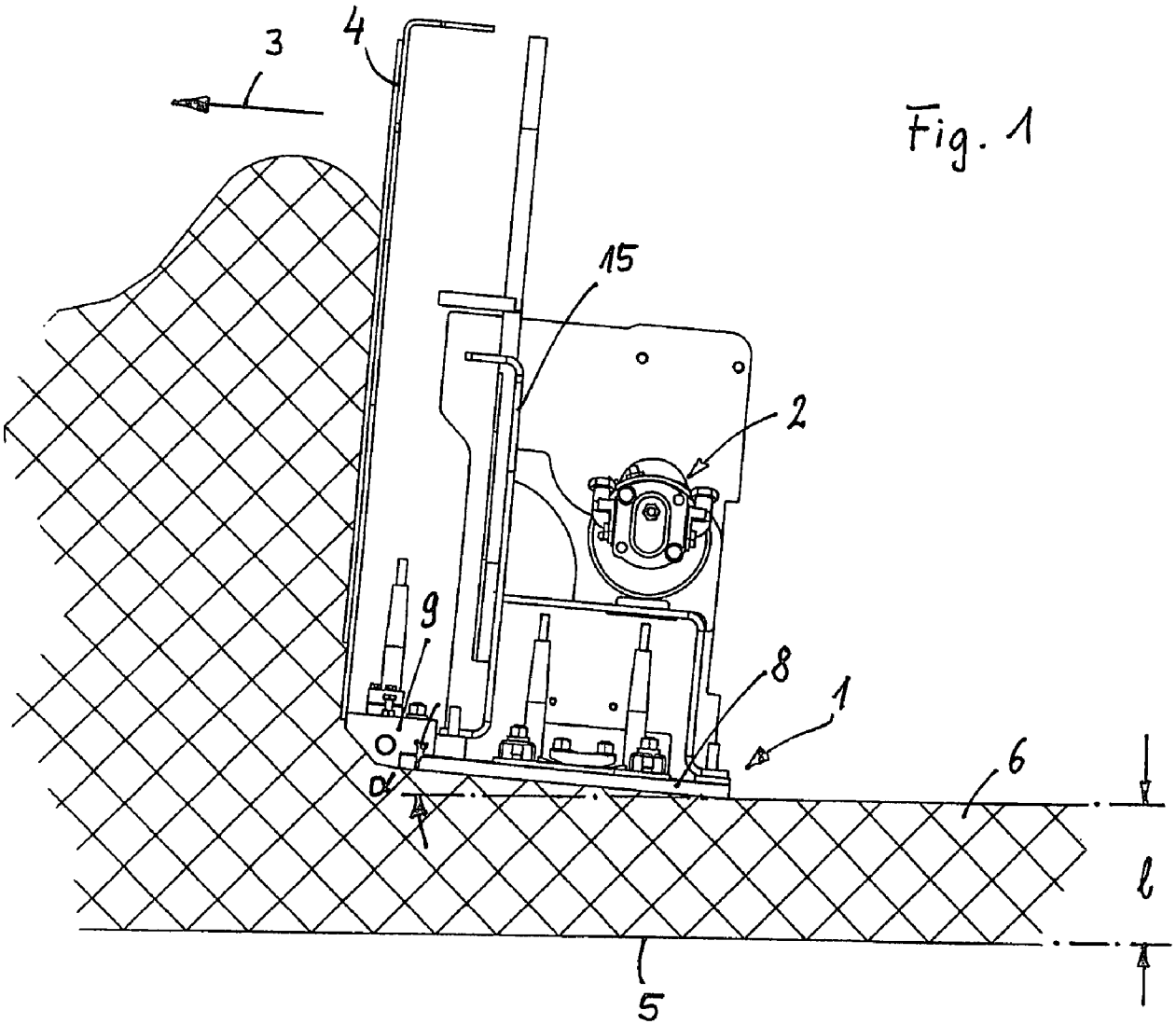
FIG. 1 schematically shows a side view of a vibratory paving screed for a paver of the invention.

The tamper-free vibratory paving screed represented schematically in FIG. 1 comprises a baseplate 1 made of steel sheet, which is coupled to a vibration drive 2 situated above it so as to induce vibrations in the—generally heatable—baseplate 1. Situated upstream of the baseplate 1 in the paving direction (arrow 3) is a front wall 4 which is fixed with respect to the baseplate 1 and whose lower edge bears against the front edge of the baseplate 1.

In the paving situation represented, a paving layer 6 is laid on a subgrade 5 by means of a paver (not shown) provided with the vibratory paving screed. The front of the paver is usually equipped with a hopper for holding paving material which is then conveyed by means of a conveyor towards the rear of its chassis into the region of a distributor auger, which is situated in front of the vibratory paving screed. The vibratory paving screed here is articulated on the chassis via tow arms and floats on the paving material, with the baseplate 1 being set at a screed angle of attack $\alpha$ with respect to the formation 5 so that, as seen in the paving direction, the front edge of the baseplate 1 is at a greater distance from the ground than its rear edge. The screed angle of attack $\alpha$ ensures a corresponding layer thickness l of the paving layer 6. The material distributed in front of the vibratory paving screed by means of the distributor auger moves downwards against the front wall 4 and then under the baseplate 1, where it is compacted, with the result that the paving layer 6 is finally given the thickness corresponding to the distance l of the rear edge of the baseplate 1 from the formation 5.

Figure 2:
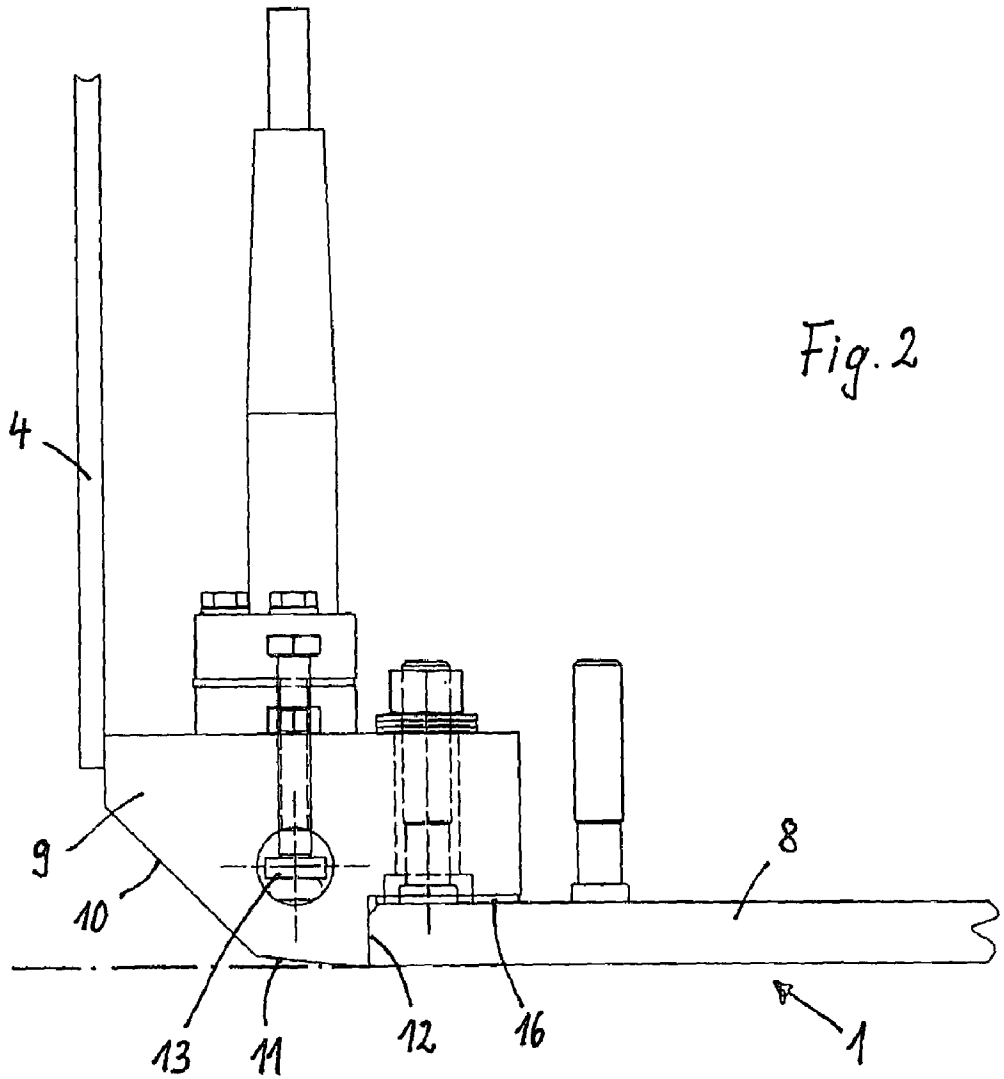
FIG. 2 schematically shows, in side view, an enlarged detail of an embodiment of the vibratory paving screed of FIG. 1.

The baseplate 1 is in two parts and consists of a section 8 of uniform thickness and, situated in the region of its front edge, of a separate, solid strip 9 connected to the section 8, this strip being provided with a metering slope 10 and also with a run-in bevel 11 which follows the metering slope 10 in the paving direction; cf., in particular, FIG. 2.

Figure 3:
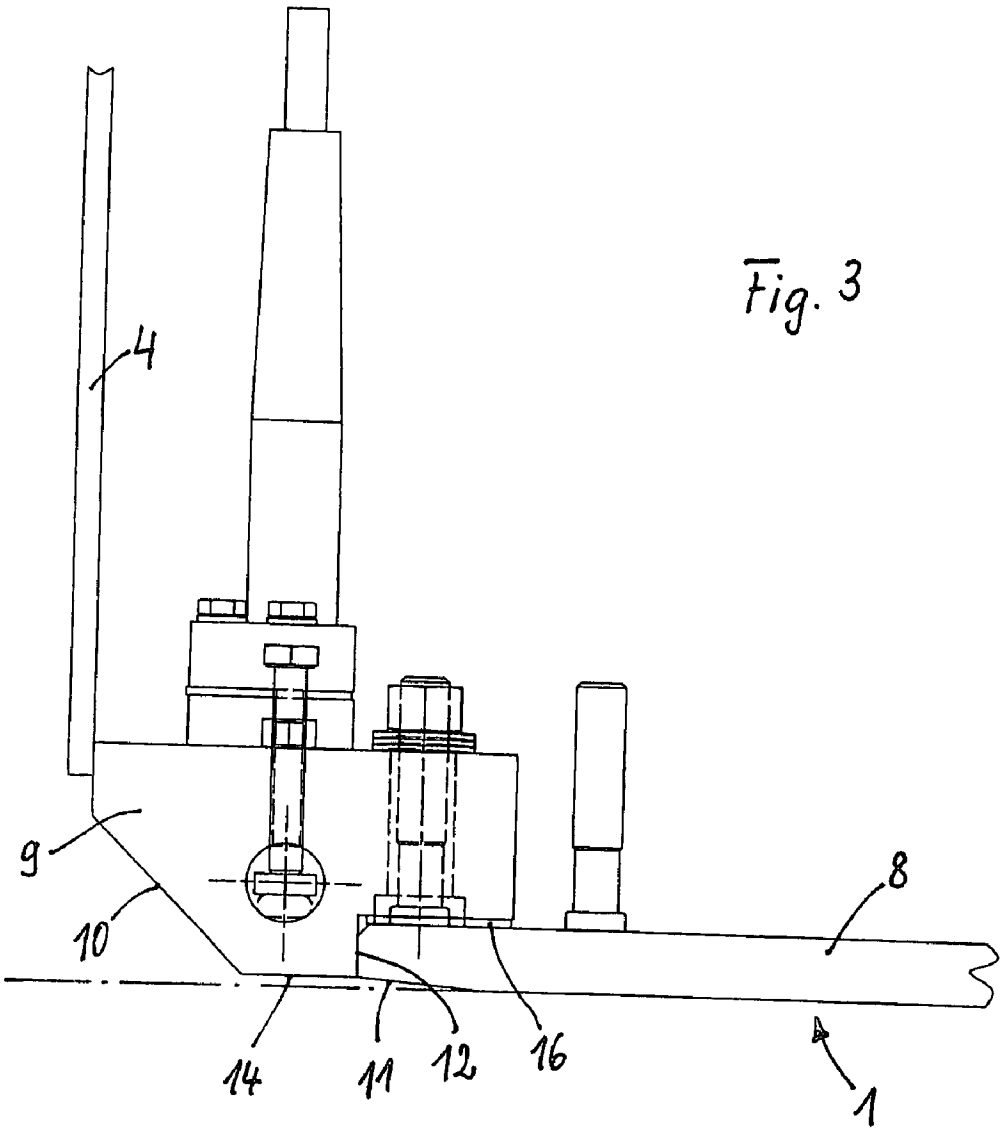
FIG. 3 schematically shows, in side view, an enlarged detail of a further embodiment of the vibratory paving screed of FIG. 1.

The transition between the metering slope 10 and run-in bevel 11 is advantageously sharp-edged. The strip 9 is expediently hardened at least in the sides coming into contact with paving material 6. The strip 9 may be fastened to the screed body via mounts 15 independently of the section 8. Furthermore, it is possible for the height of the strip 9 to be adjustable with respect to the section 8, for example by means of a shim 16 of corresponding thickness (FIG. 3).

The angle of the metering slope 10 with respect to the underside of the baseplate 1 and thus of the section 8 is expediently about 40° to 50°, in particular 45°, and satisfies the desired metering requirements for the paving material, in contrast to a bending radius which leads to ever increasing paving problems with increasing radii.

The run-in bevel 11, which expediently has an angle of about 4° to 10°, in particular 5° to 7°, with respect to the underside of the baseplate 1, and thus of the section 8, decisively counteracts uneven wear of the baseplate 1 and positively influences the handling of the vibratory paving screed.

As can be seen from FIG. 2, it may be expedient if the strip 9 bears end-on by way of a shoulder 12 against the section 8 of the baseplate 1 and extends over the latter and is also screwed to the section 8, so that the strip 9 bears tightly against the section 8 and furthermore, being a wearing part, can be easily replaced.

A heater 13 can be used to heat the strip 9 and the section 8. An electrical resistance heater or a gas heater may be used here, for example.

Whereas, in the embodiment represented in FIG. 2, the flat run-in bevel 11 is situated in the front region, as seen in the paving direction, of the section 8, in the embodiment represented in FIG. 3 the solid strip 9 comprises, behind the metering slope 10, in the paving direction, a face 14 which is parallel to the baseplate 1 and which is adjoined by a run-in bevel 11, preferably provided on the baseplate 1, the metering slope 10 advantageously merging with the parallel face 14 to form a sharp edge.

While the invention has been shown and described with reference to preferred embodiments, it should be apparent to one of ordinary skill in the art that many changes and modifications may be made without departing from the spirit and scope of the invention as defined in the claims.

What is claimed is:

1. A vibratory paving screed for a paver, comprising a baseplate a vibration drive for the base plate, and a front wall which is mounted upstream of the baseplate in the paving direction, fixed with respect to the baseplate and engaging with the baseplate, wherein the baseplate comprises a section of uniform thickness having a front edge and flat run-in bevel extending from the front edge, and a separate, solid strip disposed in the region of the front edge of the section of uniform thickness, the strip being connected to the section of uniform thickness and having a metering slope and a bottom face disposed behind the metering slope, the bottom face being substantially flush with the run-in bevel at the front edge of the section of uniform thickness, the strip extending over the section and being mounted against the latter, the strip being heatable by a heater disposed inside the solid strip.

2. The vibratory paving screed according to claim 1, wherein the metering slope has an angle of about 40° to 50° with respect to the underside of the baseplate.

3. The vibratory paving screed according to claim 1, wherein the solid strip is height-adjustable with respect to the section.

4. The vibratory paving screed according to claim 1, wherein a sharp-edged transition is provided between the metering slope and run-in bevel.

5. The vibratory paving screed according to claim 1, wherein the flat run-in bevel is situated in the front region, as seen in the paving direction, of the section.

6. The vibratory paving screed according to claim 1, wherein the run-in bevel has an angle of about 4° to 10° with respect to the underside of the baseplate.

7. The vibratory paving screed according to claim 1, wherein the solid strip has, behind the metering slop, as seen in the paving direction, a parallel face with respect to the baseplate.

8. The vibratory paving screed according to claim 7, wherein the metering slope merges with the parallel face to form a sharp edge.

9. The vibratory paving screed according to claim 1, wherein the strip is hardened at least in the sides coming into contact with paving material.

10. The vibratory paving screed according to claim 1, wherein the strip is heatable.

11. The vibratory paving screed according to claim 1, wherein the section is heatable.

12. The vibratory paving screed according to claim 1, wherein the strip is replaceable.

13. The vibratory paving screed according to claim 1, wherein the strip is fastened by way of mounts to the screed body independently of the section.

14. The vibratory paving screed according to claim 1, wherein the baseplate is adapted to compact a paving material directed under the baseplate, whereby the strip bottom face extends the section of uniform thickness for compaction of the paving material.

* * * * *